US007931007B2

(12) United States Patent
Fischer et al.

(10) Patent No.: US 7,931,007 B2
(45) Date of Patent: Apr. 26, 2011

(54) FUEL-INJECTION DEVICE

(75) Inventors: Michael Fischer, Niefern-Oeschelbronn (DE); Ulrich Fischer, Ditzingen (DE); Peter Lang, Weissach (DE)

(73) Assignee: Robert Bosch GmbH, Stuttgart (DE)

( * ) Notice: Subject to any disclaimer, the term of this patent is extended or adjusted under 35 U.S.C. 154(b) by 197 days.

(21) Appl. No.: 11/922,525

(22) PCT Filed: Dec. 7, 2007

(86) PCT No.: PCT/EP2007/063559
§ 371 (c)(1),
(2), (4) Date: Jan. 8, 2009

(87) PCT Pub. No.: WO2009/049687
PCT Pub. Date: Apr. 23, 2009

(65) Prior Publication Data

US 2010/0218742 A1 Sep. 2, 2010

(30) Foreign Application Priority Data

Oct. 15, 2007 (DE) ..... 10 2007 049 357

(51) Int. Cl.
*F02M 61/00* (2006.01)

(52) U.S. Cl. ..... 123/456; 123/467; 123/468; 123/470

(58) Field of Classification Search ..... 123/456, 123/467, 468, 469, 470
See application file for complete search history.

(56) References Cited

U.S. PATENT DOCUMENTS

| | | | | |
|---|---|---|---|---|
| 4,693,223 | A * | 9/1987 | Eshleman et al. | 123/468 |
| 5,373,824 | A * | 12/1994 | Peters et al. | 123/527 |
| 5,394,850 | A * | 3/1995 | Murphy et al. | 123/470 |
| 5,575,262 | A * | 11/1996 | Rohde | 123/467 |
| 5,785,022 | A * | 7/1998 | Haboush et al. | 123/456 |
| 6,543,421 | B2 * | 4/2003 | Lorraine et al. | 123/470 |
| 6,742,504 | B2 * | 6/2004 | Seymour et al. | 123/456 |
| 6,761,150 | B2 * | 7/2004 | Zdroik | 123/456 |
| 6,871,637 | B2 * | 3/2005 | Tsuchiya et al. | 123/467 |
| 6,892,704 | B2 * | 5/2005 | Tsuchiya et al. | 123/456 |
| 6,905,002 | B2 * | 6/2005 | Bagga et al. | 181/233 |
| 7,093,584 | B1 * | 8/2006 | Potter et al. | 123/447 |
| 7,406,946 | B1 * | 8/2008 | Watanabe et al. | 123/470 |
| 7,681,553 | B2 * | 3/2010 | Cora et al. | 123/456 |
| 2002/0043249 | A1 * | 4/2002 | Lee et al. | 123/456 |
| 2005/0133008 | A1 * | 6/2005 | Zdroik et al. | 123/456 |

(Continued)

FOREIGN PATENT DOCUMENTS

DE 102004 048 401 4/2006

(Continued)

*Primary Examiner* — Thomas N Moulis
(74) *Attorney, Agent, or Firm* — Kenyon & Kenyon LLP

(57) ABSTRACT

The fuel-injection device is characterized by an especially low-noise design. The fuel-injection device includes at least one fuel injector and a fuel rail having at least one pipe connection, the fuel injector being introduced into a receiving bore of the pipe connection, and the fuel rail having a discharge opening to supply fuel to the fuel injector. Provided between the fuel injector and the fuel rail is a pressure-wave guide connecting both, in such a way such that dynamic pressure fluctuations in the fuel injector are able to be routed largely past the volume of the receiving bore of the pipe connection. The fuel-injection device is especially suitable for the direct injection of fuel into a combustion chamber of a mixture-compressing internal combustion engine having external ignition, but it is also suitable for the injection of fuel into an intake manifold.

12 Claims, 7 Drawing Sheets

U.S. PATENT DOCUMENTS

2007/0227984 A1 10/2007 Wells et al.

FOREIGN PATENT DOCUMENTS

| | | |
|---|---|---|
| DE | 102005026992 | 12/2006 |
| FR | 2802246 | 6/2001 |
| JP | 8312495 | 11/1996 |
| JP | 2003314405 | 11/2003 |
| WO | WO2006/131426 | 12/2006 |

* cited by examiner

FUEL-INJECTION DEVICE

FIELD OF THE INVENTION

The present invention is based on a fuel-injection device of the type set forth herein.

BACKGROUND INFORMATION

A fuel-injection device is discussed in DE 10 2004 048 401 A1. The fuel-injection device includes a plurality of fuel injectors, a receiving bore in the cylinder head for each fuel injector, and an individual pipe connection of a fuel-distributor line used to supply fuel to the fuel injectors. The fuel injector is inserted into the relative solid pipe connection of the fuel-distributor line and sealed with the aid of a sealing ring. The pipe connection emerges from the actual fuel-distributor line in one piece. The fuel-distributor line is permanently connected to the cylinder head, e.g., by a screw-type connection. A U-shaped holding-down clamp is clamped between the pipe connection of the fuel-distributor line and the fuel injector.

The holding-down clamp includes a base element in the form of a partial ring, from which an axially flexible holding-down clamp having at least two legs extends at an angle. The fuel-injection device is particularly suitable for use in fuel-injection systems of mixture-compressing internal combustion engines having externally supplied ignition. During operation, hydraulic forces that are proportional to the cross-sectional area are generated with respect to the fuel injector and the fuel-distributor line; these can harm the sealing ring and are transmittable to the engine structure in the form of structure-borne noise and thereby lead to undesired sound radiation (FIG. 1).

Additional known specific embodiments of fuel-injection devices having different pipe connections are described in greater detail with the aid of FIGS. 2 and 3. These solutions can also have the previously mentioned adverse effects.

SUMMARY OF THE INVENTION

The fuel-injection device according to the present invention having the characterizing features described herein has the advantage of providing improved sealing by simple measures implemented on the fuel injector and the pipe connection of the fuel-distributor line, and of achieving reduced noise development. According to the exemplary embodiments and/or exemplary methods of the present invention, the dynamic pressure variations in the fuel during the opening and closing of the fuel injector are mostly kept away from the pipe connection by routing them through the pipe connection directly into the fuel-distributor line without triggering dynamic pressure fluctuations in the volume of the pipe connection. A pressure-wave guide, which ensures that the generation of dynamic alternating forces is reduced considerably, is used for this purpose. The result is reduced wear of the sealing rings of the fuel injector and a markedly reduced noise generation. The slowly variable buildup and reduction of pressure is retained since in high loading states the force produced by the pressure further supplements the holding down of the fuel injectors via holding-down clamps with respect to the combustion pressure of the combustion chamber.

Advantageous further refinements and improvements of the fuel-injection device indicated herein are rendered possible by the further measures specified herein.

If the pressure-wave guide is affixed on the fuel injector, it is especially advantageous if the mounting is implemented on a fuel filter or on a connection sleeve of the fuel injector, especially by an extended plastic extrusion coating or with the aid of a catch, snap-in or clip connection.

The mounting of the pressure-wave guide on the fuel-distributor line may be implemented using a catch, snap-in or clip connection.

The pressure-wave guide advantageously penetrates the receiving opening of the pipe connection and a flow opening at least partially, but especially completely, the flow opening being provided upstream from the receiving opening and having a considerably smaller diameter. The same is true for the discharge opening in the fuel-distributor line.

An annular leakage gap is formed in the region of the discharge opening of the fuel-distributor line or the flow opening of the pipe connection. Additional advantageous specific embodiments of the leakage gap may be realized by contouring the surface of the pressure-wave guide. The leakage gap between the pressure-wave guide and the wall surrounding it permits a slow buildup and reduction in pressure in the pipe connection according to the system pressure, i.e., a static pressure compensation.

Exemplary embodiments of the present invention are depicted in simplified form in the drawing and explained in greater detail in the description below.

DETAILED DESCRIPTION

Figure 1:
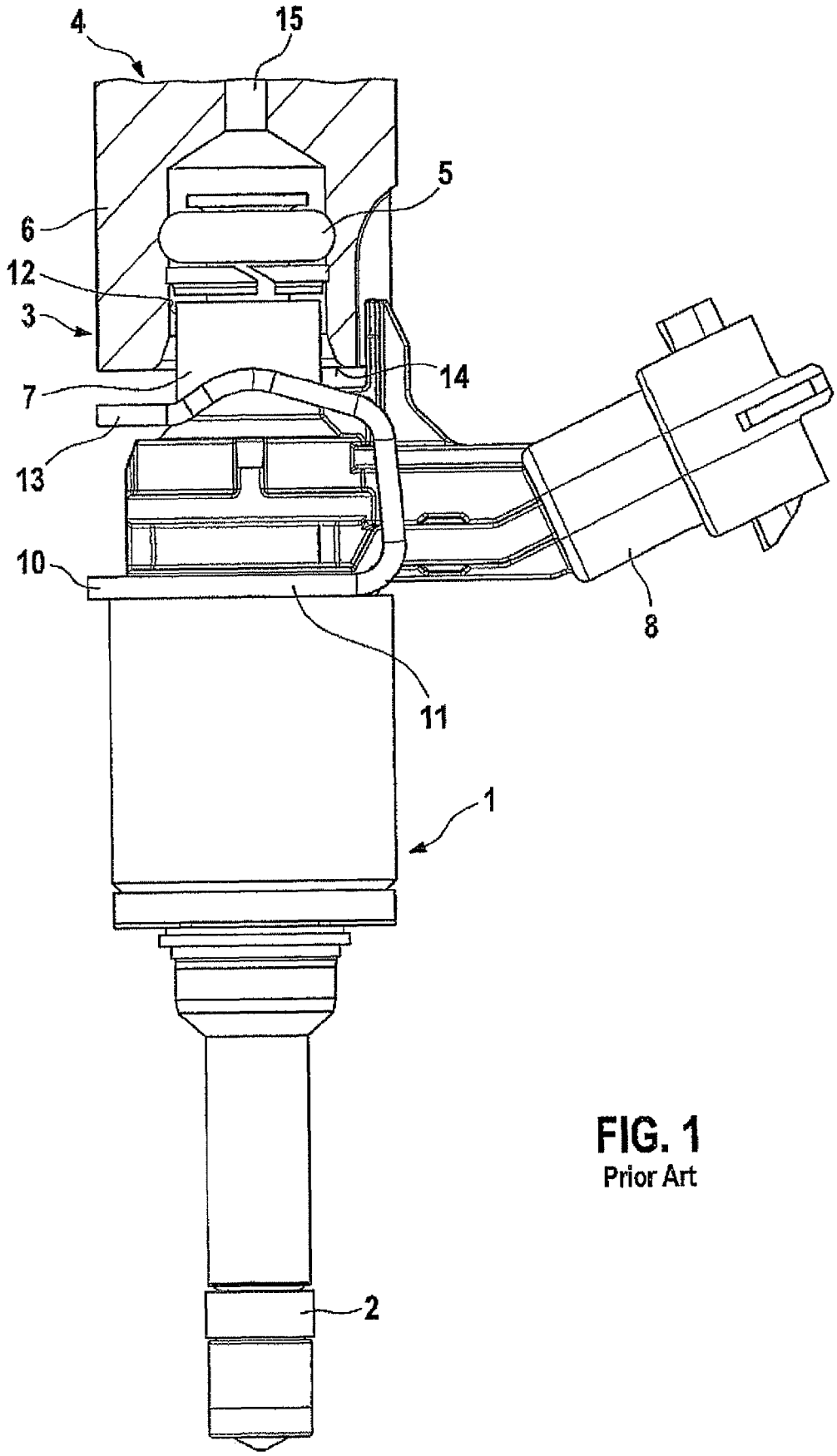
FIG. 1 Prior Art
FIG. 1 shows a partially illustrated fuel-injection device in a first available embodiment.

To understand the exemplary embodiments and/or exemplary methods of the present invention, three known specific embodiments of fuel-injection devices having different pipe connections 6 of a fuel-distributor line 4 to accommodate a fuel injector 1 and to supply it with fuel will be described in greater detail in the following text with the aid of FIGS. 1 through 3. One exemplary embodiment is shown in FIG. 1 as a side view of a valve in the form of a fuel injector 1 for fuel-injection systems of mixture-compressing internal combustion engines having externally supplied ignition. Fuel injector 1 is part of the fuel-injection device. Fuel injector 1, which is embodied as a directly injecting fuel injector for the direct injection of fuel into a combustion chamber of the internal combustion engine, is installed in a receiving bore of a not depicted cylinder head (cylinder head 9 in FIG. 2) via a downstream end. A sealing ring 2, in particular made from Teflon®, provides optimal sealing between fuel injector 1 and the wall of the cylinder head.

At its intake-side end 3, fuel injector 1 has a plug-in connection to a fuel-distributor line (fuel rail) 4, which is sealed by a sealing ring 5 between a pipe connection 6 of fuel rail 4 shown in cross-section and an inlet connection 7 of fuel injector 1. Fuel injector 1 is inserted into a receiving bore 12 of relatively solid pipe connection 6 of fuel rail 4. Pipe connection 6 emerges from actual fuel rail 4 in one piece, for example, and has a flow opening 15 with a smaller diameter upstream from receiving bore 12, via which the flow is routed in the direction of fuel injector 1. Fuel injector 1 is equipped with an electrical connection plug 8 for the electrical contacting to actuate fuel injector 1.

A holding-down clamp 10 is situated between fuel injector 1 and pipe connection 6 in order to provide clearance between fuel injector 1 and fuel rail 4 without any radial forces being exerted for the most part, and in order to securely hold down fuel injector 1 in the receiving bore of the cylinder head. Holding-down clamp 10 is designed as bow-shaped element, e.g., as stamping-bending component. Holding-down clamp 10 has a base element 11 in the form of a partial ring, from where a holding-down clip 13 extends at an angle, which rests against fuel rail 4 at a downstream end face 14 of pipe connection 6 in the installed state.

Figure 2:
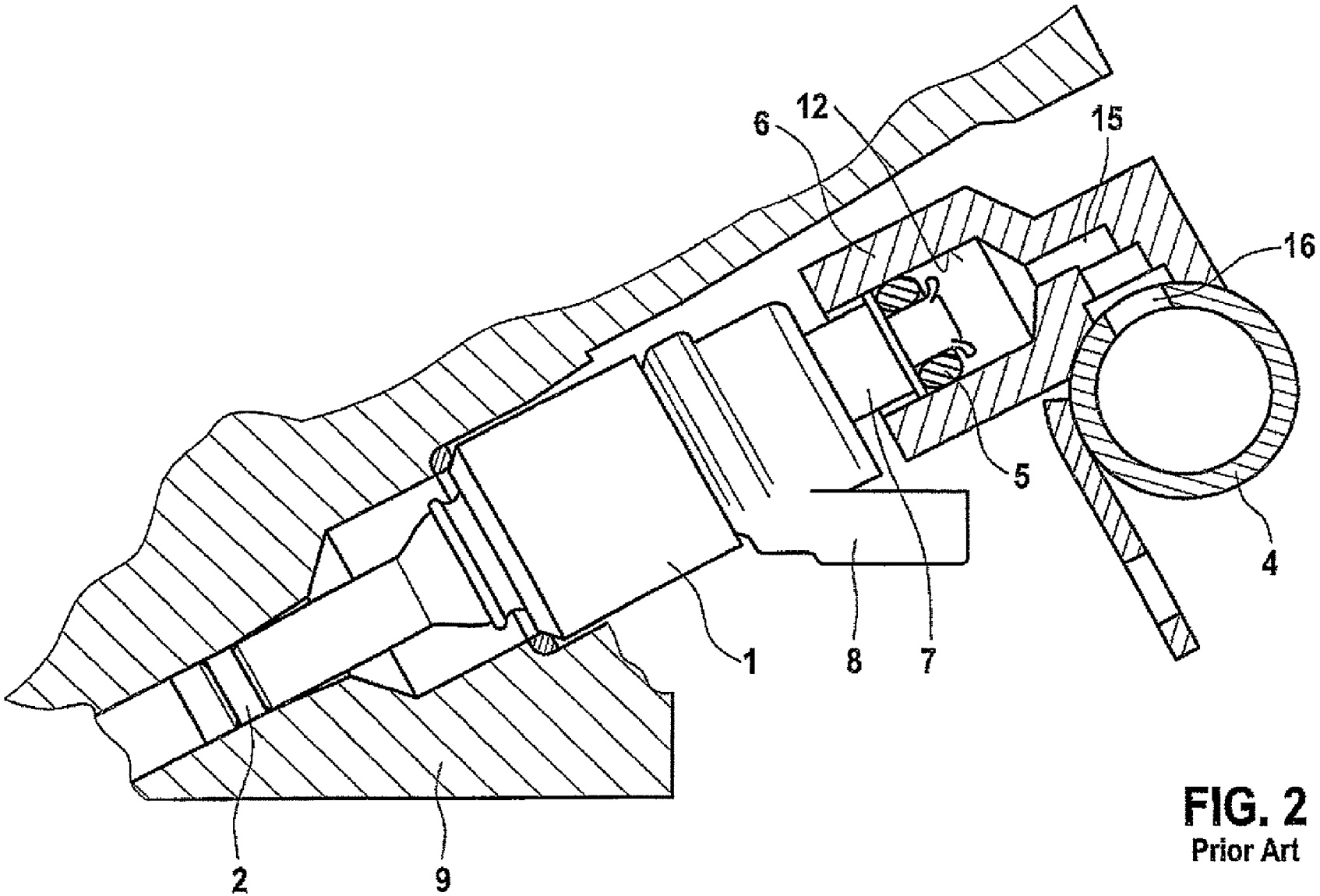
FIG. 2 Prior Art
FIG. 2 shows a partially illustrated fuel-injection device in a second available embodiment.

FIG. 2 shows a partially illustrated fuel-injection device of a second known design. This schematic cross-section through a high-pressure injection system according to the related art illustrates that various design variants of pipe connection 6 are conceivable. A fuel rail 4, which extends at an offset with respect to the longitudinal valve axes of fuel injectors 1, is provided for the supply of fuel injectors 1. Pipe connection 6 forms a connection element between fuel injector 1 and fuel rail 4, this connection element being permanently connected to fuel rail 4. Pipe connection 6 has an opening as shown in the example in FIG. 1, which is made up of a flow opening 15 and a receiving bore 12. In contrast to pipe connection 6 according to FIG. 1, flow opening 15 has an angular design, e.g., a rectangular design, so that discharge opening 16 of fuel rail 4 and receiving bore 12 of pipe connection 6 are not in mutual alignment. In all other respects pipe connection 6 has a cup-shaped design ("rail cup").

Figure 3:
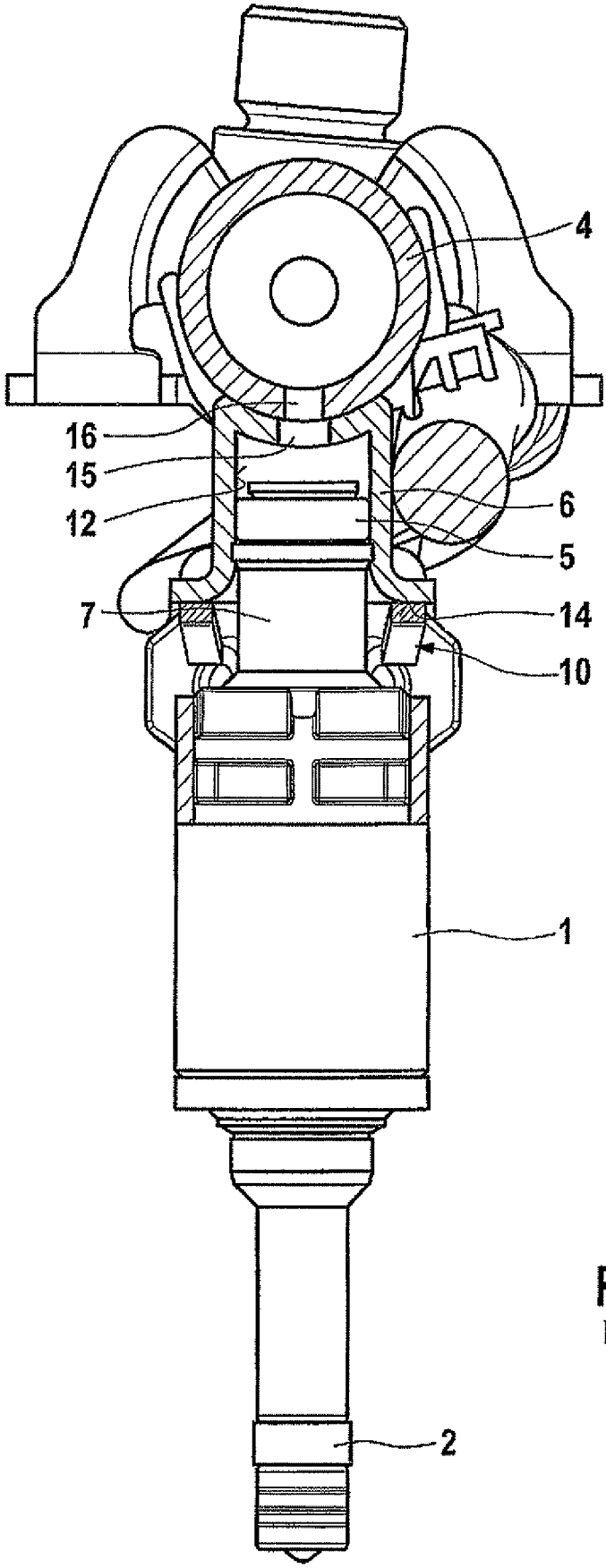
FIG. 3 Prior Art
FIG. 3 shows a partially illustrated fuel-injection device in a third available embodiment.

FIG. 3 shows a partially depicted fuel-injection device of a third known design. This known approach is quite similar to the design shown in FIG. 1 in its basic configuration. In contrast to FIG. 1, however, pipe connection 6 does not emerge from fuel rail 4 in one piece. Instead, pipe connection 6 constitutes a separate, for example deep-drawn, cup-shaped component, which is permanently connected to fuel rail 4 by jointing (e.g., brazing). The wall thickness of pipe connection 6 is therefore reduced considerably, which also results in a short extension length of flow opening 15. Pipe connection 6 is mounted on fuel rail 4 in such a way that discharge opening 16 of fuel rail 4, flow opening 15, and receiving bore 12 of pipe connection 6 are aligned with one another.

To sum up, the following can be said. In virtually all known systems for the direct injection of fuel, fuel injectors 1 are connected to pipe connection 6 of fuel rail 4 via a plug-in connection. The plug-in connection is realized within a pipe connection 6 embodied as a rail cup, into which fuel injector 1 is inserted. The sealing with respect to the outside is accomplished by an elastomer sealing ring 5 mounted on an inlet connection 7 of fuel injector 1. During operation, hydraulic forces are generated with respect to fuel injector 1 and fuel rail 4 via the fuel pressure applied in pipe connection 6, the forces being proportional to the cross-sectional area. In today's typical designs these amount to roughly 10 N/bar. For one, the pressure change occurs slowly by the buildup and reduction of the system pressure as a function of the driving states, this typically occurring between 50 bar in idling operation and 200 bar in full-load operation. For another, a highly dynamic variation of the pressure takes place at each injection due to the pressure waves inside fuel injector 1 that are triggered thereby (typically, 10 to 40 bar peak-peak amplitude).

The highly dynamic pressure variations triggered during the operation of fuel injectors 1 produce strong alternating forces, which act on fuel rail 4 and fuel injectors 1. The low-frequency component<1 kHz can have a noticeable adverse effect on the sealing function of sealing ring 5 in pipe connection 6 and also on the sealing of fuel injectors 1 with respect to the combustion chamber by sealing ring 2, due to the forced relative movements. The high-frequency component of 1 to 5 kHz in turn is transferred to the entire engine structure (cylinder head 9 among them) as structure-borne noise via fuel injectors 1 and fuel rail 4, where it leads to an undesired sound radiation, which may result in audible ticking noises.

According to the exemplary embodiments and/or exemplary methods of the present invention, the highly dynamic pressure variations are largely kept away from pipe connection 6 in that they are routed through pipe connection 6 directly into fuel rail 4 without triggering dynamic pressure variations in the volume of pipe connection 6. This is accomplished with the aid of a pressure-wave guide 20, which has a tubular design. Pressure-wave guide 20 ensures that the development of dynamic alternating forces is markedly reduced. This results in reduced wear of sealing rings 2, 5 and in considerably reduced noise generation. The slowly variable buildup and reduction in pressure is retained since in states of high loading the force produced by the pressure further supplements the holding down of fuel injectors 1 by holding-down clamps 10 with respect to the combustion pressure of the combustion chamber. In general, the exemplary embodiments and/or exemplary methods of the present invention is also realizable in a multipoint-injection system.

Figure 4:
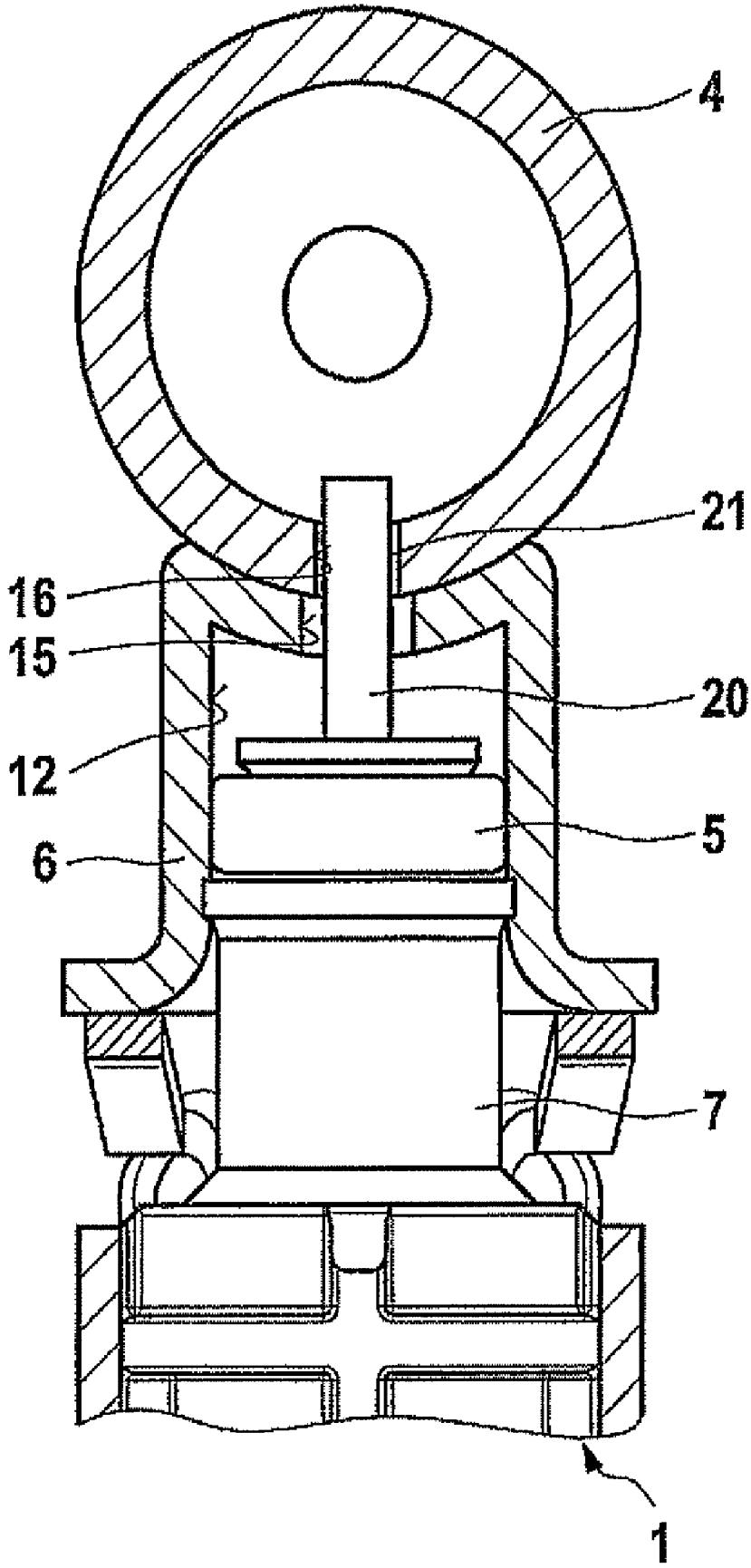
FIG. 4 shows a detail of the fuel-injection device in the region of the joining of pipe connection and fuel injector together with a pressure-wave guide according to the exemplary embodiments and/or exemplary methods of the present invention in a basic representation.

FIG. 4 shows a basic representation of a partial view of the fuel-injection device in the region of the joining of pipe connection 6 and fuel injector 1 together with pressure-wave guide 20 according to the exemplary embodiments and/or exemplary methods of the present invention, the partial view being based on the development according to FIG. 3. Pressure-wave guide 20 is realized as a thin pipe having a continuous longitudinal opening, and is permanently joined to fuel injector 1 at its inflow-side end. Starting at fuel injector 1, pressure-wave guide 20 projects through receiving bore 12, flow opening 15 and discharge opening 16 in the upstream direction, and slightly into the interior of fuel rail 4. In this way pressure-wave guide 20 connects fuel injector 1 to fuel rail 4. The pressure waves in the fuel produced by the opening and closing of fuel injector 1 run through pressure-wave guide 20 past the volume of receiving opening 12 of pipe connection 6 without creating pressure variations and thus alternating forces there. Complete penetration of discharge opening 16 by pressure-wave guide 20 is not mandatory.

An annular leakage gap 21 is formed in the region of discharge opening 16 of fuel rail 4, which is penetrated by pressure-wave guide 20. Leakage gap 21 between pressure-wave guide 20 and the wall of discharge opening 16 permits a slow buildup and reduction in pressure in pipe connection 6 according to the system pressure, i.e., a static pressure compensation. This additional, not sealed connection combines the advantages of a genuine line connection of fuel injectors 1 to fuel rail 4 with the simple and cost-effective plug-in solution for the connection to fuel rail 4.

Figure 5:
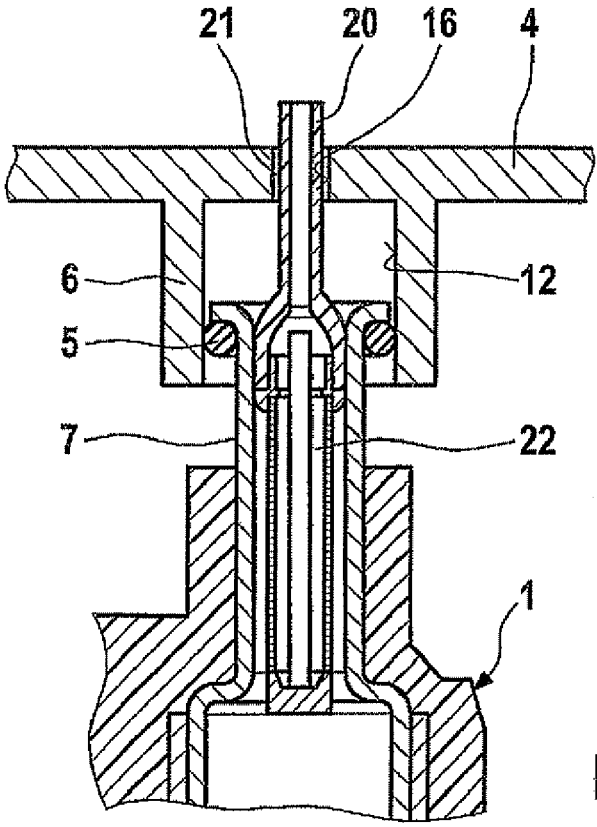
FIG. 5 shows a first embodiment of a pressure-wave guide according to the present invention.

Various approaches according to the exemplary embodiments and/or exemplary methods of the present invention are conceivable to produce the line connection between fuel injector 1 and the volume of fuel rail 4 with the aid of pressure-wave guide 20. FIG. 5 schematically illustrates a first embodiment of a pressure-wave guide 20 according to the present invention. In this exemplary embodiment, pressure-wave guide 20 is made of, for example, a media-resistant plastic (polyamide) and is mounted on a fuel filter 22 of fuel injector 1 by pressing in or clipping. It is also conceivable to form pressure-wave guide 20 in one piece on the plastic base element of fuel filter 22.

Figure 6:
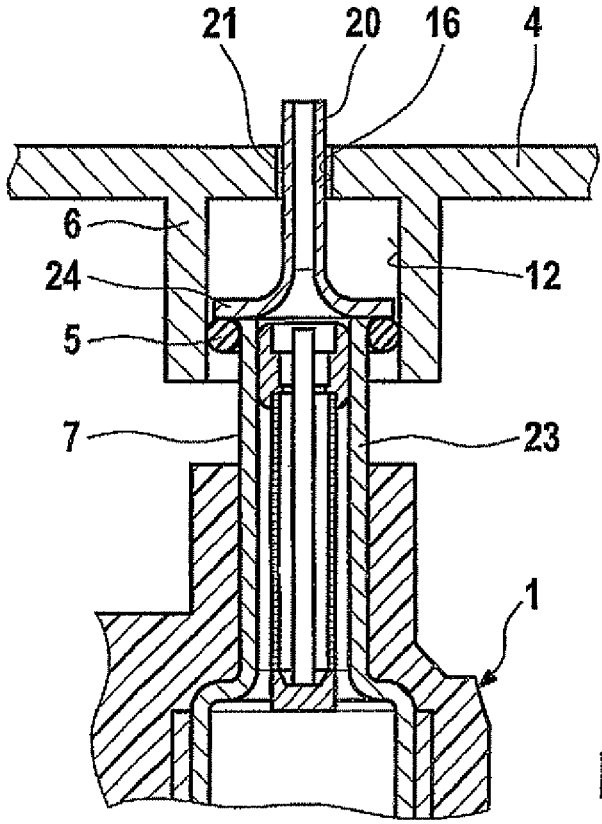
FIG. 6 shows a second embodiment of a pressure-wave guide according to the present invention.

FIG. 6 schematically illustrates a second embodiment of a pressure-wave guide 20 according to the present invention. In this specific embodiment pressure-wave guide 20 is made of metal, for example, and pressure-wave guide 20 is affixed on, e.g., a connection sleeve 23 of fuel injector 1 by a flange 24 that extends radially in an outward direction, using bonding, welding, soldering, etc. Here, too, an integral design is conceivable, in which pressure-wave guide 20 emerges directly from a deep-drawn or turned connection sleeve 23. The exemplary embodiments shown in FIGS. 5 and 6 have no permanent connection of pressure-wave guide 20 to fuel rail 4. Instead, a clearance fit is provided to produce leakage gap 21. However, if a press fit is realized, then channel- or groove-type or screw-type depressions may be formed on the outer circumference of pressure-wave guide 20.

Figure 7:
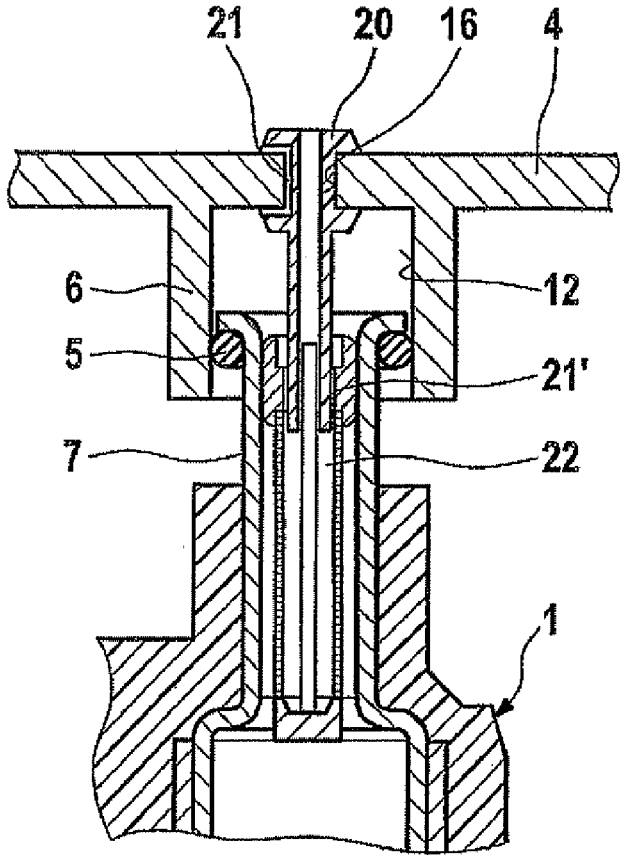
FIG. 7 shows a third embodiment of a pressure-wave guide according to the present invention; the pressure-wave guides illustrated in FIGS. 5 through 7 are suitable for a fuel-injection device according to FIGS. 1 and 3.
Figure 8:
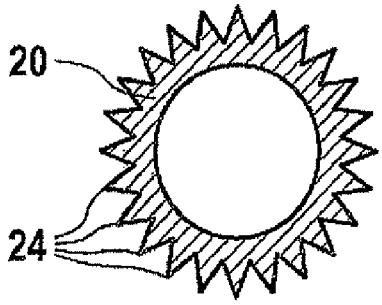
FIG. 8 shows a cross-section through a pressure-wave guide in the region of a leakage gap.
Figure 9:
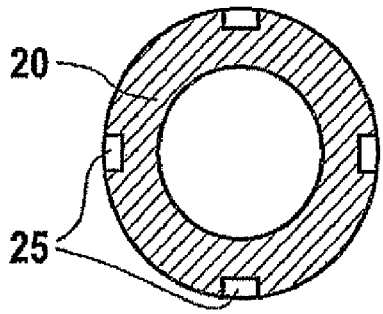
FIG. 9 shows another cross-section through a pressure-wave guide in the region of a leakage gap.

FIG. 7 shows a third embodiment of a pressure-wave guide 20 according to the present invention, in which pressure-wave guide 20 is fixed in place on fuel rail 4 and freely projects into fuel injector 1, e.g., into fuel filter 22. Pressure-wave guide 20 is mounted on fuel rail 4 with the aid of, e.g., a catch, snap-in, clip connection or similar device. The permanent connection is implemented in such a way that a leakage gap 21 remains. As an alternative or in addition, a second leakage gap 21' may be provided as well, i.e., between pressure-wave guide 20 and fuel filter 22 or some other component of fuel injector 1 surrounding pressure-wave guide 20. FIGS. 8 and 9 show cross-sections through pressure-wave guide 20 in the region of leakage gap 21'; it can be seen that the outer surface of pressure-wave guide 20 is contoured. For example, the outer surface of pressure-wave guide 20 may have longitudinal ribs 24 (FIG. 8) or longitudinal channels or grooves 25 (FIG. 9).

Figure 10:
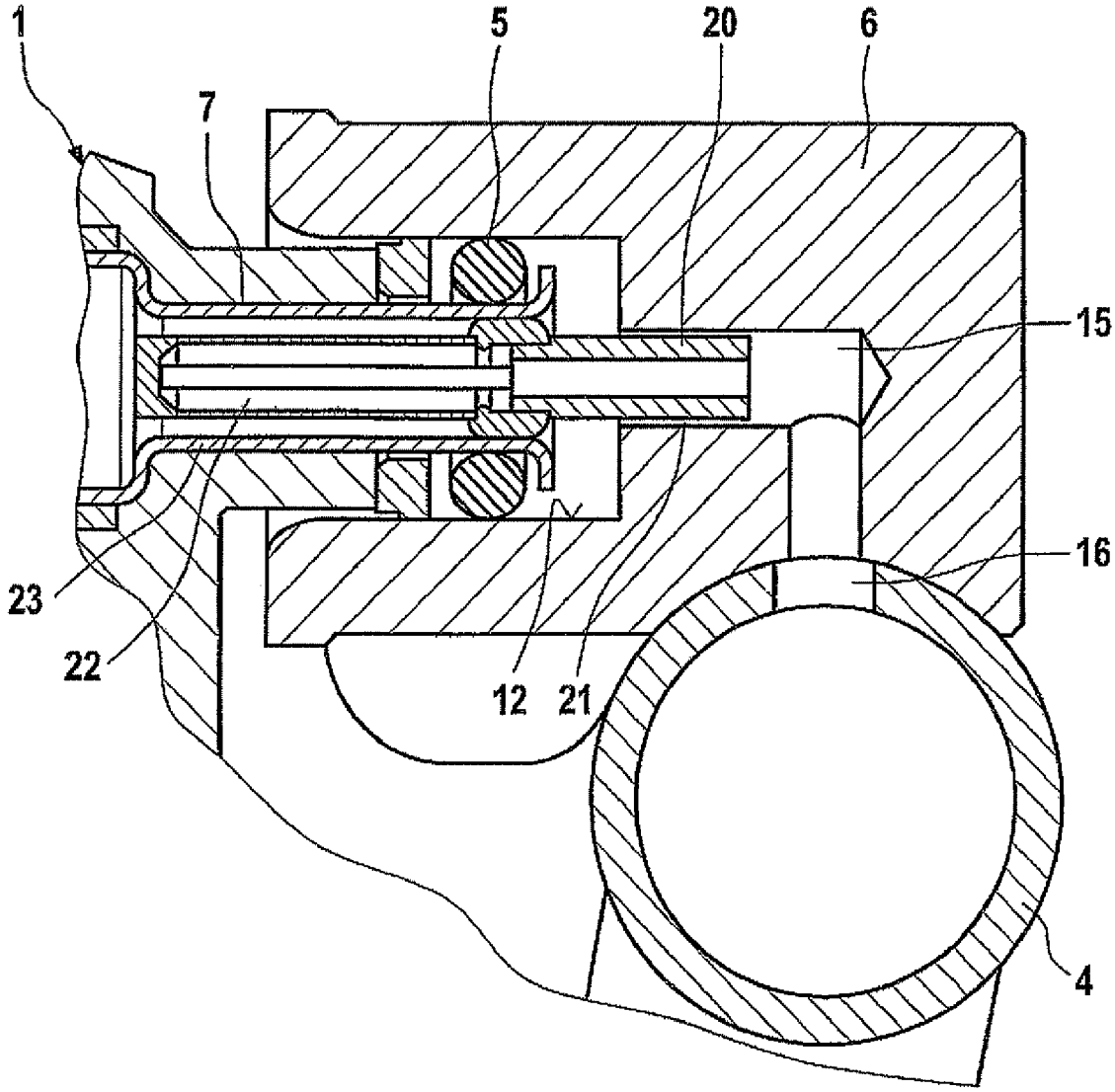
FIG. 10 shows a fourth embodiment of a pressure-wave guide according to the present invention; this pressure-wave guide is suitable for a fuel-injection device according to FIG. 2.

Pressure-wave guides 20 shown in FIGS. 5 through 9 are suitable for a fuel-injection device according to FIGS. 1 and 3. These exemplary embodiments do not require a complete penetration of discharge opening 16 by pressure-wave guide 20. FIG. 10 shows a fourth embodiment of a pressure-wave guide 20 according to the present invention; this pressure-wave guide 20 is suitable for a fuel-injection device according to FIG. 2. Pressure-wave guide 20 is either affixed on fuel filter 22 of fuel injector 1 by pressing or clipping it in or on, or it is integrally formed on the plastic base element of fuel filter 22. As an alternative, pressure-wave guide 20 may also be connected to connection sleeve 23 of fuel injector or emerge in one piece directly from a deep-drawn or turned connection sleeve 23. In contrast to the previously described exemplary embodiments, pressure-wave guide 20 is projecting only into a portion of flow opening 15 of pipe connection 6, but does not project up to discharge opening 16 of fuel rail 4 positioned at a right angle thereto. However, the positive effect of routing the dynamic pressure variations past the volume of receiving bore 12 of pipe connection 6 is achieved in this case as well.

What is claimed is:

1. A fuel-injection device for a direct fuel-injection system of an internal combustion engine, comprising:

at least one fuel injector;

a fuel rail having at least one pipe connection, the at least one fuel injector being inserted into a receiving bore of the pipe connection, and the fuel rail having a discharge opening for delivering fuel to the fuel injector; and a pressure-wave guide provided between the fuel injector and the fuel rail so that dynamic pressure fluctuations in the fuel injector are largely able to be routed past a volume of the receiving bore of the pipe connection.

2. The fuel-injection device of claim 1, wherein the pressure-wave guide has a tubular design with a continuous longitudinal opening.

3. The fuel-injection device of claim 1, wherein the pressure-wave guide is made of metal or plastic.

4. The fuel-injection device of claim 1, wherein the pressure-wave guide is affixed on one of the fuel injector and the fuel rail.

5. The fuel-injection device of claim 4, wherein the pressure-wave guide is one of (i) affixed on one of a fuel filter and a connection sleeve of the fuel injector; and (ii) emerges in one piece from one of the fuel filter and the connection sleeve of the fuel injector.

6. The fuel-injection device of claim 5, wherein the pressure-wave guide is affixable on the fuel filter by one of pressing it in and clipping it on.

7. The fuel-injection device of claim 4, wherein the pressure-wave guide is affixable on the fuel rail with one of a catch, a snap-in connection and a clip connection.

8. The fuel-injection device of claim 1, wherein the pipe connection of the fuel rail has a flow opening upstream from the receiving bore, which has a considerably smaller diameter than the receiving bore and which is at least partially penetrated by the pressure-wave guide.

9. The fuel-injection device of claim 1, wherein the pressure-wave guide projects at least partially through the discharge opening of the fuel rail.

10. The fuel-injection device of claim 9, wherein the pressure-wave guide penetrates the discharge opening of the fuel rail at least partially with a clearance fit, thereby forming a leakage gap.

11. The fuel-injection device of claim 8, wherein the pressure-wave guide penetrates the flow opening of the pipe connection of the fuel rail at least partially with a clearance fit, thereby forming a leakage gap.

12. The fuel-injection device of claim 8, wherein a leakage gap is formed between the pressure-wave guide and the wall surrounding it, by depressions formed as one of channels, grooves and threads on an outer periphery of the pressure-wave guide.

* * * * *